United States Patent [19]

Rhyne

[11] Patent Number: 4,590,61(

[45] Date of Patent: May 20, 198(

[54] HANGING PRODUCT DISPLAY PACKAGES

[75] Inventor: Steven B. Rhyne, Chattanooga, Tenn.

[73] Assignee: Rhyne & Company, Chattanooga, Tenn.

[21] Appl. No.: 701,378

[22] Filed: Feb. 14, 1985

[51] Int. Cl.[4] ..... B65D 33/14

[52] U.S. Cl. ..... 383/23; 206/45.33; 206/806; 383/31; 383/66; 383/84

[58] Field of Search ..... 383/23, 22, 24, 25, 383/26, 27, 30, 31, 66, 84, 87; 206/45.34, 806, 45.33

[56] References Cited

U.S. PATENT DOCUMENTS

| | | | |
|---|---|---|---|
| 3,098,561 | 7/1963 | Kass | 206/45.33 |
| 3,429,498 | 2/1969 | Dorfman | 383/27 |
| 3,500,995 | 3/1970 | Forman | 383/66 X |
| 3,549,085 | 12/1970 | Hart | 383/23 |
| 3,651,929 | 3/1972 | Stoll | 206/45.33 |
| 3,693,867 | 9/1972 | Schwarzkopf | 383/27 |
| 3,695,418 | 10/1972 | Gwozdz | 206/45.33 |
| 3,782,622 | 1/1974 | Montgomery | 383/23 X |
| 4,084,689 | 4/1978 | Yamagata | 383/23 X |
| 4,347,930 | 9/1982 | Herrin | 206/45.34 |
| 4,385,722 | 5/1983 | Brewill | 206/45.34 X |

FOREIGN PATENT DOCUMENTS

| | | | |
|---|---|---|---|
| 1486223 | 2/1969 | Fed. Rep. of Germany | 383/84 |
| 2111459 | 7/1983 | United Kingdom | 383/2: |

*Primary Examiner*—William Price
*Assistant Examiner*—Bryon Gehman
*Attorney, Agent, or Firm*—Alan Ruderman

[57] ABSTRACT

Two hangable display packages, one being a plastic bag container and the other a cardboard box container, have a separate rigid plastic hanger for hanging on a rod or the like of a display rack. The plastic bag is of a different material than the plastic hanger which is disposed within a pocket formed at the top of the bag with the hook portion of the hanger extending through a hole in the top peripheral edge of the bag, and the bag has layers thereof bonded together slightly below the lower edges of arms of the hanger to entrap the hanger within the bag. A method of forming the hangable package by properly positioning the hanger within the bag and bonding the layers of the bag together while the top edge of the hanger arms are properly positioned against the top peripheral edge of the bag is disclosed. The cardboard box package has an extension of the rear wall in which a slit is formed along a fold line and an arcuate slot is formed in the rear wall at a disposition for receivably capturing the leading edge of the extension so that the hook of the hanger may be positioned within the slit and the extension folded down and retained within the arcuate slot.

2 Claims, 11 Drawing Figures

HANGING PRODUCT DISPLAY PACKAGES

BACKGROUND OF THE INVENTION

This invention relates to packaging of articles of merchandise adapted to be hung on display racks, and more particularly to packages wherein the articles may be carried in a container of one material supported by a hanger of another material and the method of forming such packages.

Merchandising of packaged articles often comprises the hanging of such packaged articles from a peg or rod extending from a perforated display board. Some of these packages include a transparent or translucent plastic bag constructed of polyethylene in which the articles may be viewed and which is provided with a hole for receiving the peg or rod from which it is suspended. Other packages comprise cardboard or similar boxes formed with an integral tab provided with the peg receiving hole. However, when potential consumers are shopping they tend to remove the packages from the pegs to closely view the merchandise and, if they decide against the purchase, the packages are thereafter replaced on the peg. Thus, one major difficulty with packages of this construction is that after a number of removals and replacements of the packages on the display the material around the support hole in the plastic bag and the tabs of the cardboard boxes tend to tear, thereby preventing further hanging of the packages. Another type of display hanger, especially used for merchandising socks and the like, has a plastic hook having an elongated arm extending in a first direction from the lower end of the hook and bent back to form another arm spaced from and underlying the first arm, the article merely being draped over and suspended from the lower arm. After an article has been removed and replaced a number of times from such hangers, the hanger has a tendency to break at the bend connecting the upper and lower arms.

To overcome these difficulties the prior art has devised a number of constructions in which a separate hanger is utilized in conjunction with the article carrying package.

In the utilization of a plastic bag package a plastic hanger has been disposed through a slit in the top of the bag and bonded to the bag. However, since the bags are generally constructed from polyethylene, in order to bond a hanger to this material the hanger must also be constructed from polyethylene. Polyethylene, however, is a flexible material and hangers constructed of this material are somewhat flimsy and cannot support much weight. Thus, the hook portion of the hanger tends to spread open while hanging on the display rack peg with the result that the packages tend to fall off the peg. Polypropylene plastic is a more rigid material than polyethylene, but these materials cannot be bonded together. Although a polypropylene hanger may be bonded to a polypropylene bag, polypropylene is a more expensive material and the additional cost generally is not warranted for use as the bag material. Polystyrene is a more rigid material than either polyethylene or polypropylene, but is also more expensive. Thus, even if it could be used for constructing the bag, its cost would be prohibitive, especially when packaging inexpensive products such as socks and underwear. Thus, where polystyrene hangers have been used in conjunction with polyethylene bags they have either merely been loosely positioned and unsecured within the bag with the hook of the hanger extending out through a slot in the top of the bag, or have been secured by an adhesive as disclosed, for example, in Brewill U.S. Pat. No. 4,385,722. In the former instance the hanger tends to fall into the bag when it is not supporting the package, and in the latter instance an adhesive must be applied to the bag material.

In the utilization of cardboard packages a separate plastic hanger has been used by either specially constructed hangers to retain the hanger from falling into the package, such as illustrated in Herrin U.S. Pat. No. 4,347,930 or they have been retained by sandwiching between a pair of shells forming the package, such as illustrated in Strongwater U.S. Pat. No. 4,349,102. In the former instance special assembly techniques must be utilized to flex and position the hanger, while in the latter instance the package itself must be specially configured such that it is not applicable to most merchandised articles. Moreover, in the merchandising of certain items, the package may include an upstanding wall on which size, price and other such information is displayed, and with the constructions illustrated in the aforesaid patents, the hook portion of the hanger would mask a portion of that wall. Thus, the known hanging display packages have strength, cost and/or limited applications.

SUMMARY OF THE INVENTION

Consequently, it is a primary object of the present invention to provide hangable display packages having a hanger formed from one material for supporting an article container which is formed from another material, and a method for manufacturing such packages.

It is another object of the present invention to provide packaging for articles of merchandise which are hung on a display board, the articles being carried within a container of plastic or cardboard and supported from the display board by hangers retained by the container, and a method for manufacturing such packaging.

It is a further object of the present invention to provide hangable display packaging for articles of merchandise which are supported on display pegs or rods by a rigid hanger formed from a plastic material different from the material used for constructing the container within which the articles are carried, the hanger being securely retained by portions of the container while permitting the container to be opened for inspection and which may be utilized in conjunction with conventional printed material surfaces on the packaging, and a method for producing such packaging.

Accordingly, one aspect of the present invention is the provision of a plastic bag package having a rigid hanger for supporting the package from a display peg or rod, the bag being formed from polyethylene and the hanger being formed from a rigid plastic material such as polystyrene. The hanger has a pair of arms which extend outwardly in opposite directions from a hook portion and engage a closed upper end of the bag, the hook portion extending through an aperture in the upper end. The hanger is retained in this position by bonding portions of the bag together below the arms of the hanger so that there is a pocket formed for trapping the arms of the hanger while the hook portion protrudes through the bag. With this construction the hanger and bag may be formed of different plastic materials and a rigid hanger may support an inexpensive package while precluding the possibility of the hanger falling into the bag. Since a rigid hanger may be utilized, the hook of the hanger will not spread apart while carrying an article on the display rack peg or rod.

To secure the hanger within the bag, the method of the present invention provides bonding apparatus including a resiliently mounted alignment member having a dog about which the hook of the hanger may be secured and a pair of spaced positioning blocks against which the upper edge of the arms of the hanger may abut when a bag having the hanger disposed through the opening in the upper end is stretched against the resilient force acting on the alignment member. Thus, to form the pocket about the arms of the hanger, the hanger is disposed in the top of the bag between a pair of front and rear surfaces with the hook extending through a hole formed at the central portion of the upper end. The hook is secured to the dog of the alignment member and the bag is stretched against the bias of the alignment member until the upper edge of the arms abut the positioning blocks with the upper end of the bag sandwiched therebetween. Surfaces of the bag are thereafter bonded together spaced from the lower surface of the arms so as to entrap the hanger in a pocket formed between the bond and the upper end of the bag.

Another aspect of the invention is the provision of a cardboard package having a separate rigid plastic hanger for supporting the package from a display peg or rod, the package including a cardboard box container having a construction such that the hanger is entrapped between a pair of upstanding wall members. For example, one wall, preferably the rear wall, has an integral tab which is folded down to overlay the upper portion of the remainder of the wall, and the line of juncture or fold line between the tab and the remainder of the wall has a slot for receiving the hook portion of the hanger, the arms of the hanger being disposed between the tab and the remainder of the wall and when supporting the box abuts the fold line. An arcuate slot in the rear wall is formed at the disposition of the free edge of the tab remote from the line of juncture or fold line for receiving the free edge of the tab to entrap the hanger arms. Preferably a portion of the tab and the corresponding surface of the rear wall project above the top wall of the box so that graphical material may be displayed on the forward facing surface, such surface being determined by the direction of fold of the tab. The tab may be folded forwardly into the box in which case a surface of the tab may carry this graphical material or the tab may be folded rearwardly in which case the forward facing surface of the upstanding portion of the rear wall may include such information. In either case the leading or free edge of the tab may be received within the arcuate slot.

In the method of forming the cardboard box package the steps include forming an extension of the surface which is to form the rear wall, the extension providing the tab; forming the hook receiving slot and the arcuate slot, the hook receiving slot being formed at the disposition of the eventual fold line and the arcuate slot at the disposition of the eventual leading edge of the tab after folding; thereafter folding the tab at the disposition of the hook receiving slot; disposing the hanger at the fold line with the hook extending through the hook receiving slot; and inserting the free end of the tab within the arcuate slot.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
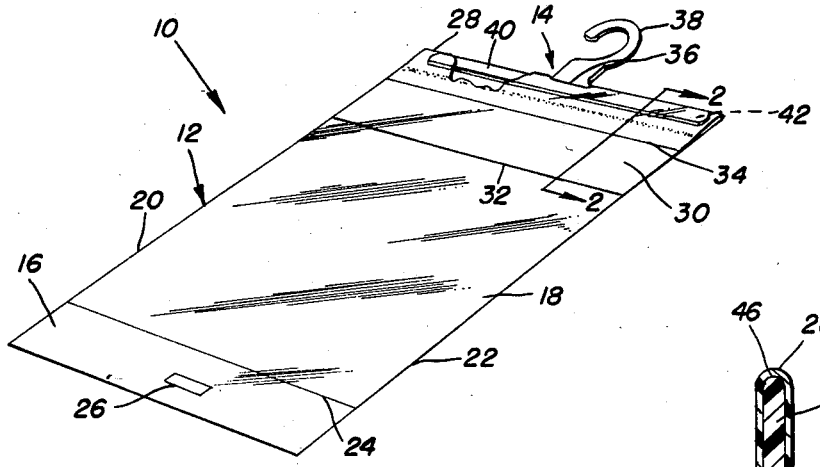
FIG. 1 is a perspective view of a plastic bag package constructed in accordance with the principles of a first aspect of the present invention.
Figure 2:
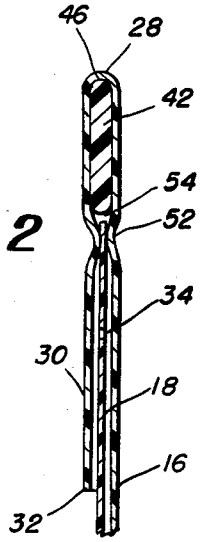
FIG. 2 is a cross sectional view taken substantially along line 2—2 of FIG. 2.

Referring now to the drawings, FIG. 1 illustrates a hangable display package 10 constructed in accordance with the first aspect of the present invention, the package generally comprising a plastic bag 12 capable of being supported on a display rack by means of a hanger 14. The bag, which preferably comprises an inexpensive translucent or transparent plastic material such as polyethylene, preferably is formed from two sheets 16, 18 of the plastic film. The layers are bonded together at opposed edges 20, 22 to form the sides of the bag. Conventionally, the bag has one sheet, e.g., 16 longer than the other at both the upper and lower ends. The lower end forms a closure for the package when folded back along the lower edge 24 of the shorter sheet 18 and may have an adhesive which is protected by a paper covering 26 until an article is placed within the bag and the bag is closed. The elongated upper end portion of the sheet 16 is folded back at the top edge 28 of the bag onto the sheet 16 so as to form a flap 30, the side edges of the flap being bonded to the sheet 18 and to the main portion of the sheet 16 when the sides 20, 22 are formed. The lower edge 32 of the flap is unsecured to form an opening, while the sheet 18 has a slit 34 so that a consumer may insert his or her hand up below the edge 32 and have entry into the bag through the slit 34.

The bag construction so far described is conventional. In accordance with the present invention a slot 36 is cut in the top edge 28 of the bag for receiving a hook portion 38 of the hanger 14. The hanger comprises a rigid plastic material such as polystryene (or if less rigidity is desired it may be polypropylene) and has a pair of arms 40, 42 extending outwardly in opposite directions from the hook portion 38. The arms 40, 42 have respective upper edges 44, 46 and lower edges 48, 50, the hook 38 extending upwardly from the central portion of the hanger intermediate the edges 44, 46. When the hanger is positioned with the hook extending through the opening 36 the sheets 16 and 18 and the flap 30 are bonded together at 52 just beneath the lower edges 48, 50 of the arms 40, 42 and the central portion therebetween so as to form a pocket 54 for the arms 40, 42, thereby to entrap the hanger against falling into the bag. When the hook 38 is hung on a peg or rod of a display rack, the top edge 28 of the bag is carried on the upper edges 44, 46 of the arms so as to support the package. In this manner a rigid hanger of polystyrene or the like is fastened to an inexpensive bag of another material such as polyethylene.

Figure 4:
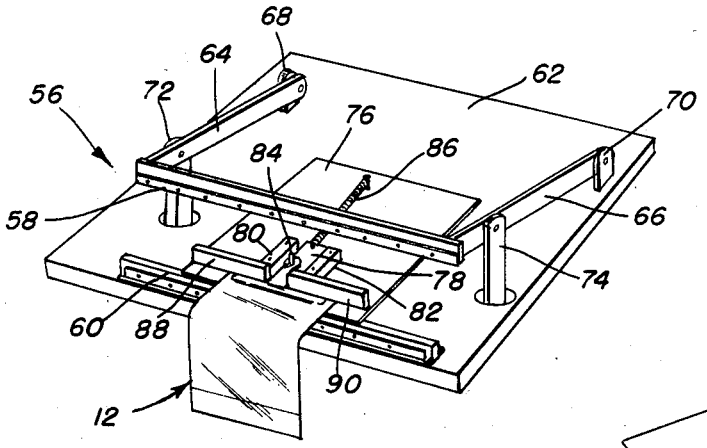
FIG. 4 is a perspective view of a bonding apparatus of the present invention with a package positioned prior to extension of the bag to the bonding position.
Figure 3:
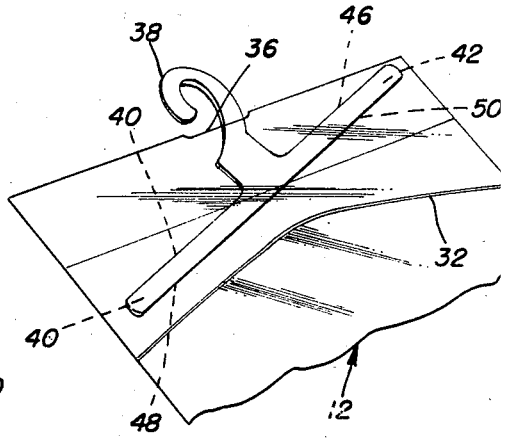
FIG. 3 is a fragmentary perspective view of the upper portion of the package of FIG. 1 illustrating an intermediate step in the insertion of the hanger within the plastic bag.
Figure 5:
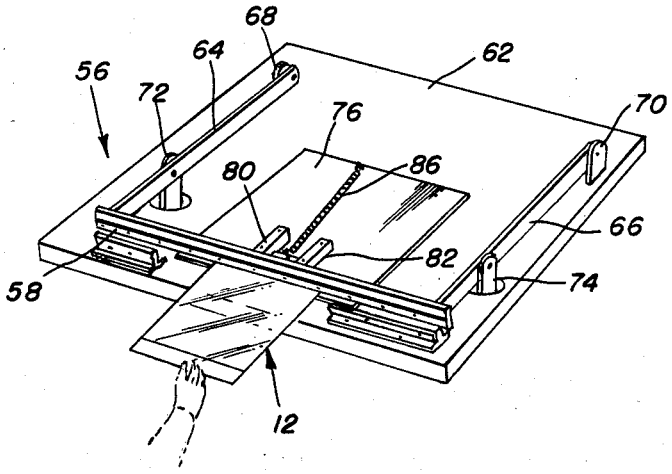
FIG. 5 is a view similar to FIG. 4 with the bag extended for bonding and the bonding apparatus in the bonding position.
Figure 6:
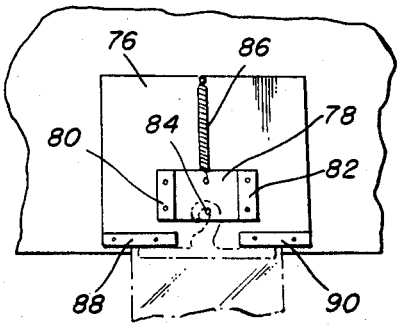
FIG. 6 is a fragmentary top plan view of the apparatus of FIG. 4 with parts removed for purposes of illustration.

To attach the hanger 14 to the bag in this manner bonding apparatus 56, as illustrated in FIGS. 4 through 6, is utilized. The apparataus 56 comprises a conventional heated bonding iron 58 which acts selectively against an anvil 60 mounted on a table 62. The iron 58 is pivotably carried by levers 64, 66 which are pivotably mounted at their ends on ears 68, 70 and selectively brought into engagement with the anvil 60 by levers 72, 74 moved by conventional means. Fastened on the table 62 is a jig plate 76 on which a slideable alignment block 78 is mounted between a pair of guide blocks 80, 82. Secured on the slide block 78 is a dog in the form of a pin 84 about which the crotch of the hook 38 may be positioned. An extension spring member 86 having one end secured to the slide block 78 and its other end secured to the jig plate 76 acts to normally urge the slide block rearwardly away from the anvil 60.

Secured on the jig plate 76 intermediate the anvil 60 and the guide blocks 80, 82 on opposite sides of the slide block 78 is a respective positioning block 88, 90. The disposition of the positioning blocks 88 and 90 is such that when a hanger 14 is disposed within the bag 12 as heretofore described the upper edges 44 and 46 of the hanger abut the blocks 88 and 90 respectively with the top edge 28 of the bag disposed therebetween when the crotch of the hook is captured by the dog 84 and the slide block 78 is urged forwardly by stretching the bag as illustrated in FIG. 5. The iron 58 may thereafter be activated to bond the layers 16, 18 and the upper portion of the flap together at the location 52 spaced very slightly, i.e., approximately one quarter inch, from the location of the lower edges 48, 50 of the hanger arms 40, 42. Thus, the process of locking the hanger into the bag includes capturing the hook 38 on the dog 84 while the hanger is disposed in the bag with the hook extending from the hole 36, and thereafter tensioning the bag by pulling the bag until the arms 40, 42 abut the positioning blocks 88, 90 at the upper surfaces 44, 46 of the hanger arms.

Figure 8:
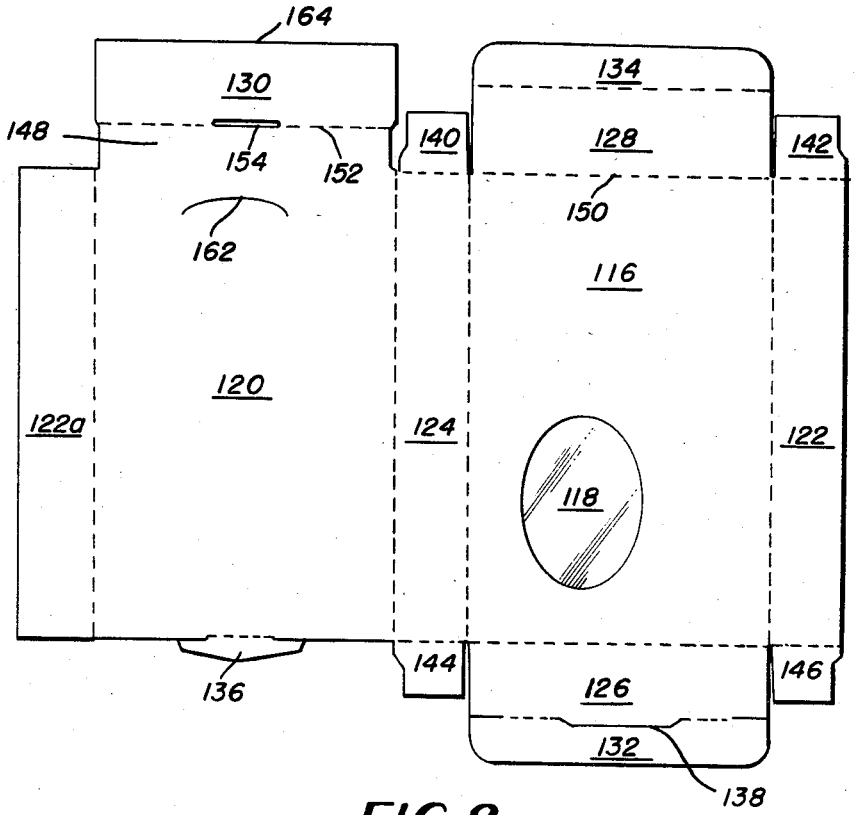
FIG. 8 is a plan layout of a box construction for forming the cardboard container portion of the package illustrated in FIG. 7.
Figure 7:
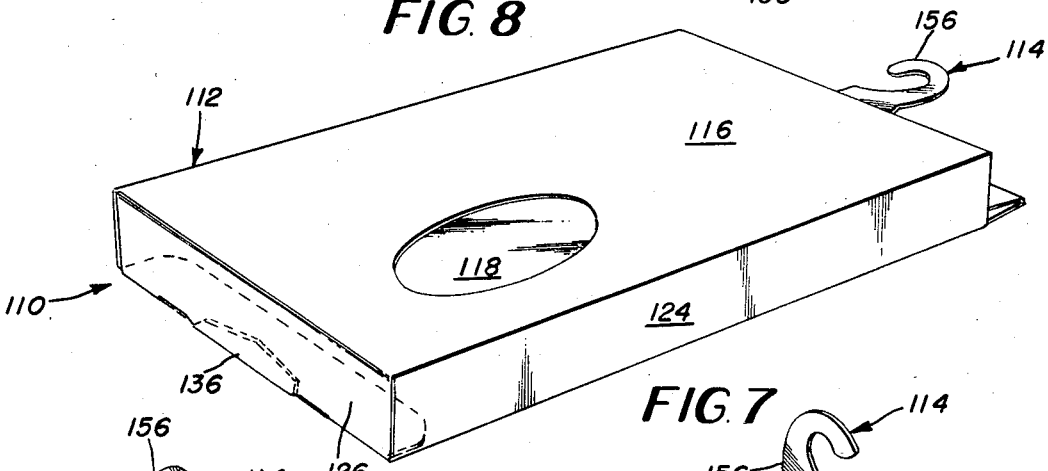
FIG. 7 is a perspective view of the box container package formed from a box constructed in accordance with the principles of an other aspect of the present invention.
Figure 10:
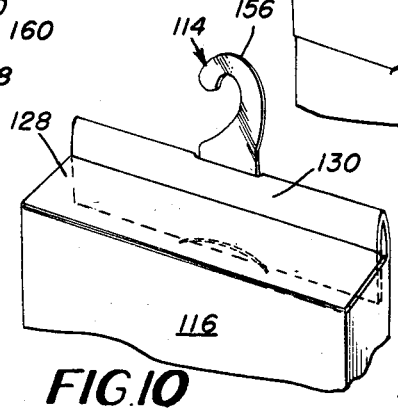
FIG. 10 is a view similar to FIG. 9 but with the top closed and the tab disposed within the box.

Another aspect of the invention is a cardboard box package 110 illustrated in FIG. 7, the package comprising a cardboard box container 112 and a rigid plastic hanger 114 for supporting the package from a display rack peg or the like. The hanger 114 is similar to, and may be identical to, the hanger 14 of the plastic bag package and may be formed from polystyrene or similar material. The box 112 comprises a front wall 116 which may have a transparent plastic window 118 for viewing the articles disposed within the box, a rear wall 120, a pair of side walls 122, 124, a bottom 126 and a top 128. The box, as hereinafter described, and as best illustrated in FIG. 10, also includes an upstanding display wall 130. As illustrated in FIG. 8 the box is formed from material shaped and cut from cardboard having rectangular portions thereon corresponding to various surfaces of the box including a gluing surface **122*a* to which the side 122** is adhesively secured when the box is assembled.

Conventional friction tabs 132, 134 are provided for the bottom 126 and the top 128 respectively and a closing tab 136 may be provided for reception into a corresponding slot 138 formed in the central portion of the junction between the bottom 126 and the corresponding friction tab 132. Conventional shoulder tabs 140, 142 are provided at the top of the box and similar tabs 141, 146 are provided at the bottom for supporting the top 128 and the bottom 126 respectively when the box is closed.

The upstanding wall 130 extends from a surface 148 which in turn is an extension of the rear wall 120 above the border 150 of the front wall 116 and the top of the sides 122, 124. Formed at the junction line 152 between the wall 130 and the surface 148, preferably at the central portion thereof, is a slit 154. The slit is sized for receiving the neck of the hook portion 156 of the hanger 114 when the hanger is operatively positioned, the remainder of the hanger 114 having arms 158 and 160 similar to the arms 40 and 42 of the hanger 14. An arcuate slot 162 is formed in the rear wall 120 at a disposition for receiving the free edge 164 of the wall 130 when the wall 130 is folded downwardly along the junction line 152 for purposes to be described, the edge 164 being retained by complimentary portions of the wall in which the slot is formed.

Figure 9:
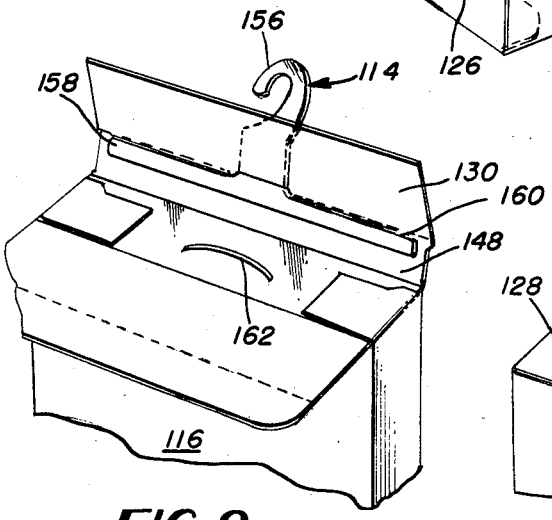
FIG. 9 is a fragmentary perspective view of the upper portion of the package of FIG. 8 illustrating the hanger in position just prior to closing the top of the box and the hanger retaining tab.

To form the box container package the material is shaped in the conventional manner to provide the form illustrated in FIG. 8. The box container is formed by folding along the designated fold lines illustrated by the dashed lines in FIG. 8. The hook 156 of the hanger 114 is then inserted into the slit 54, preferably from the interior of the box as illustrated in FIG. 9, the arms 158, 160 thereby being between the wall 130 and the surface 148 and the edge 164 of the wall 130 being received in the arcuate slot 162 within the interior of the box. Thus, when the hook 156 is positioned about a display rack peg or rod, the upper surfaces of the arms 158, 160 susbstantially abut the junction line or fold line 152 and the adjoining surfaces of the wall 130 and the surface 148. The top 128 may then be closed. The slot 162 holds the wall 130 and thus the hanger 114 in position while in use as illustrated in FIG. 10 without resort to additional sealing or adhesive means.

Figure 11:
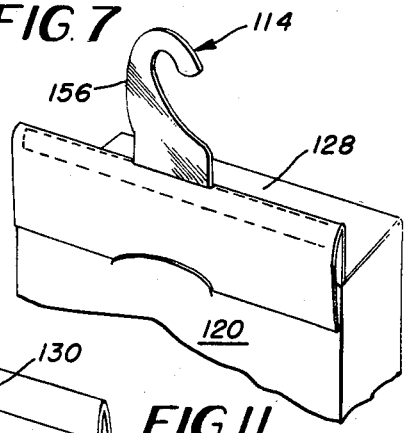
FIG. 11 illustrates an alternate tab closing arrangement for the box package.

In FIG. 11 an alternative arrangement is illustrated with the same structure. Here the wall 130 is folded rearwardly away fron the interior of the box and the edge 164 is positioned within the slot 162 on the outside of the box. In either case graphics may be placed on the wall 130 above the top 128 without obstruction by the hook. Moreover, if graphical information is not desired the extension surface 148 may be omitted and the wall 130 folded into engagement with the slot 162 which of course would be at a lower disposition.

Numerous alterations of the structure herein disclosed will suggest themselves to those skilled in the art.

However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A hangable display package including a plastic bag for containing an article of merchandise and a rigid hanger for hangably supporting the bag from a rod or the like, said hanger comprising a hook member and a pair of arms having upper and lower edges disposed below and extending away from the hook in opposite directions, said bag having a closed top formed by superposed layers of a sheet of material forming a front surface and folded to form a flap extending partly in superposed relationship relative to said front surface, another sheet of plastic material forming the rear surface of said bag and being partly disposed intermediate said front surface and said flap in superposed relationship with said front surface, said front surface, rear surface and flap being secured together at common edges defining the sides of the package, a slit formed in the rear surface above the lower edge of the flap to permit an entry into the bag protected by the flap, an upper peripheral edge of the bag defined at the fold, an opening formed in the central portion of said peripheral edge, said hanger being disposed within said bag with said hook projecting outside of the bag through said opening, and the upper edges of said arms abutting said peripheral edge when said hanger supports the bag, and said front surface, rear surface and flap being fixedly joined together at a location above the slit and beneath the lower edges of said arms to secure the hanger in the bag without closing entry through the slit into the bag.

2. A hangable display package as recited in claim 1, wherein said plastic bag comprises polyethylene and said hanger comprises polystyrene.

* * * * *